US010443221B2

(12) United States Patent
Metzel et al.

(10) Patent No.: US 10,443,221 B2
(45) Date of Patent: Oct. 15, 2019

(54) TOILET PLUNGER

(71) Applicant: Carl Freudenberg KG, Weinheim (DE)

(72) Inventors: Doug Metzel, Berwyn, IL (US); Conrad Alfaro, Bolingbrook, IL (US)

(73) Assignee: CARL FREUDENBERG KG, Weinheim (DE)

( * ) Notice: Subject to any disclaimer, the term of this patent is extended or adjusted under 35 U.S.C. 154(b) by 0 days.

(21) Appl. No.: 15/874,615

(22) Filed: Jan. 18, 2018

(65) Prior Publication Data

US 2019/0218759 A1 Jul. 18, 2019

(51) Int. Cl.
*E03C 1/308* (2006.01)

(52) U.S. Cl.
CPC ..... *E03C 1/308* (2013.01)

(58) Field of Classification Search
CPC ..... E03C 1/308; E03C 1/30; E03C 1/304
USPC ..... 4/255.11
See application file for complete search history.

(56) References Cited

U.S. PATENT DOCUMENTS 766,734 A * 8/1904 Schellhammer ..... E03C 1/308 4/255.02
2,203,185 A * 6/1940 Walus ..... E03C 1/308 4/255.11
2,846,698 A * 8/1958 Tomlinson ..... E03C 1/308 4/255.11
8,307,468 B2 11/2012 Stein
8,650,670 B2 * 2/2014 Stein ..... E03C 1/308 4/255.11
2014/0115768 A1 5/2014 Wang

* cited by examiner

*Primary Examiner* — Janie M Loeppke
(74) *Attorney, Agent, or Firm* — Leydig, Voit & Mayer, Ltd.

(57) ABSTRACT

A resiliently deformable toilet plunger including a generally cup-shaped bell portion having an interior space. A socket is formed on the bell portion. A flange portion extends from the bell portion opposite the socket and includes an open end. The flange portion defines an arcuate tapering tubular passage wherein the interior space communicates with the open end. An annular skirt is formed at a junction of the bell portion and the flange portion, the skirt including a base portion attached to the bell portion and a terminal end opposite the base portion, the skirt extending outwardly from the junction and at an angle such that the terminal end is below a plane defined by the junction, wherein the angle is from about 20° to about 70°.

17 Claims, 2 Drawing Sheets

TOILET PLUNGER

FIELD OF THE DISCLOSURE

The present disclosure relates to toilet plungers.

BACKGROUND OF THE INVENTION

The device under consideration relates to a toilet plunger. Toilet plungers are well known and widely used in homes, offices, restaurants, retail establishments, and other sites where toilets are installed. Conventional plungers are made of a rubber material having a generally cup, bell or concave-shaped body attached to a handle. Other plungers are made of a flexible plastic and have a bellows-type configuration. It is further appreciated that the conventional use of a plunger is to unclog the exit structure of a toilet or other types of plumbing.

Toilets come in a variety of sizes and configurations. Designing a plunger to effectively form a seal with most or all toilets is challenging. A well-known defect of conventional plungers is what is commonly referred to as "splash-back," which describes the effect of water splashing back towards the user when the plunger becomes stuck in a compressed state and unexpectedly decompresses while used in a toilet or while removal from a toilet. The sudden decompression of the plunger causes the material in the toilet bowl to splash undesirably. The poor sealing of conventional plungers also causes or contributes to ineffective removal of plumbing clogs.

SUMMARY OF THE DISCLOSURE

In one aspect, the disclosure describes a resiliently deformable toilet plunger, including a generally cup-shaped bell portion having an interior space. A socket is formed on the bell portion. A flange portion extends from the bell portion opposite the socket and includes an open end. The flange portion defines an arcuate tapering tubular passage wherein the interior space communicates with the open end. An annular skirt is formed at a junction of the bell portion and the flange portion, the skirt including a base portion attached to the bell portion and a terminal end opposite the base portion, the skirt extending outwardly from the junction and at an angle such that the terminal end is below a plane defined by the junction, wherein the angle is from about 20° to about 70°.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims. The terms configured and configuration as used herein refer to a specified structural size and shape.

Figure 1:
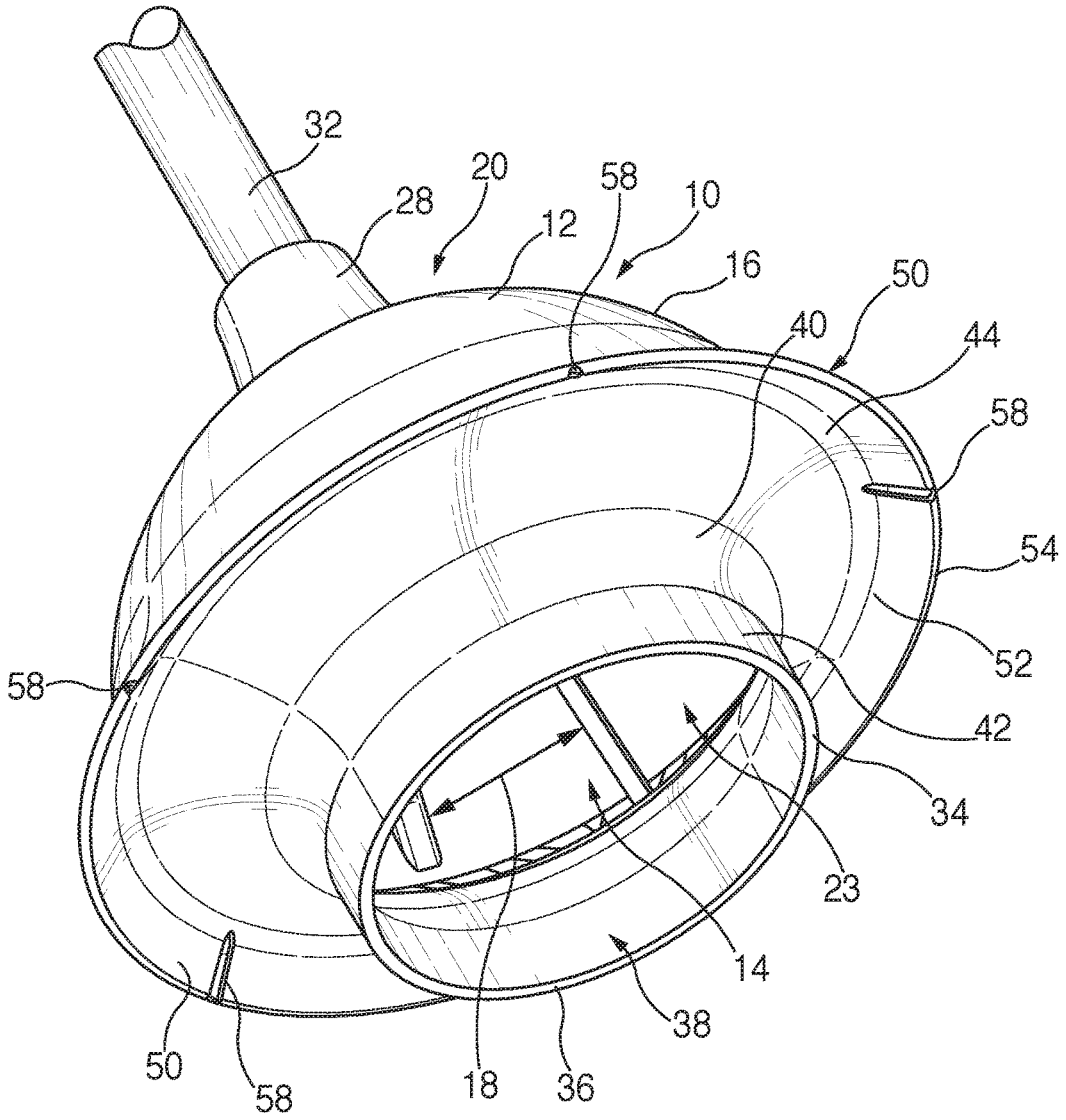
FIG. 1 is a bottom perspective view of a toilet plunger according to one embodiment of the disclosure.
Figure 2:
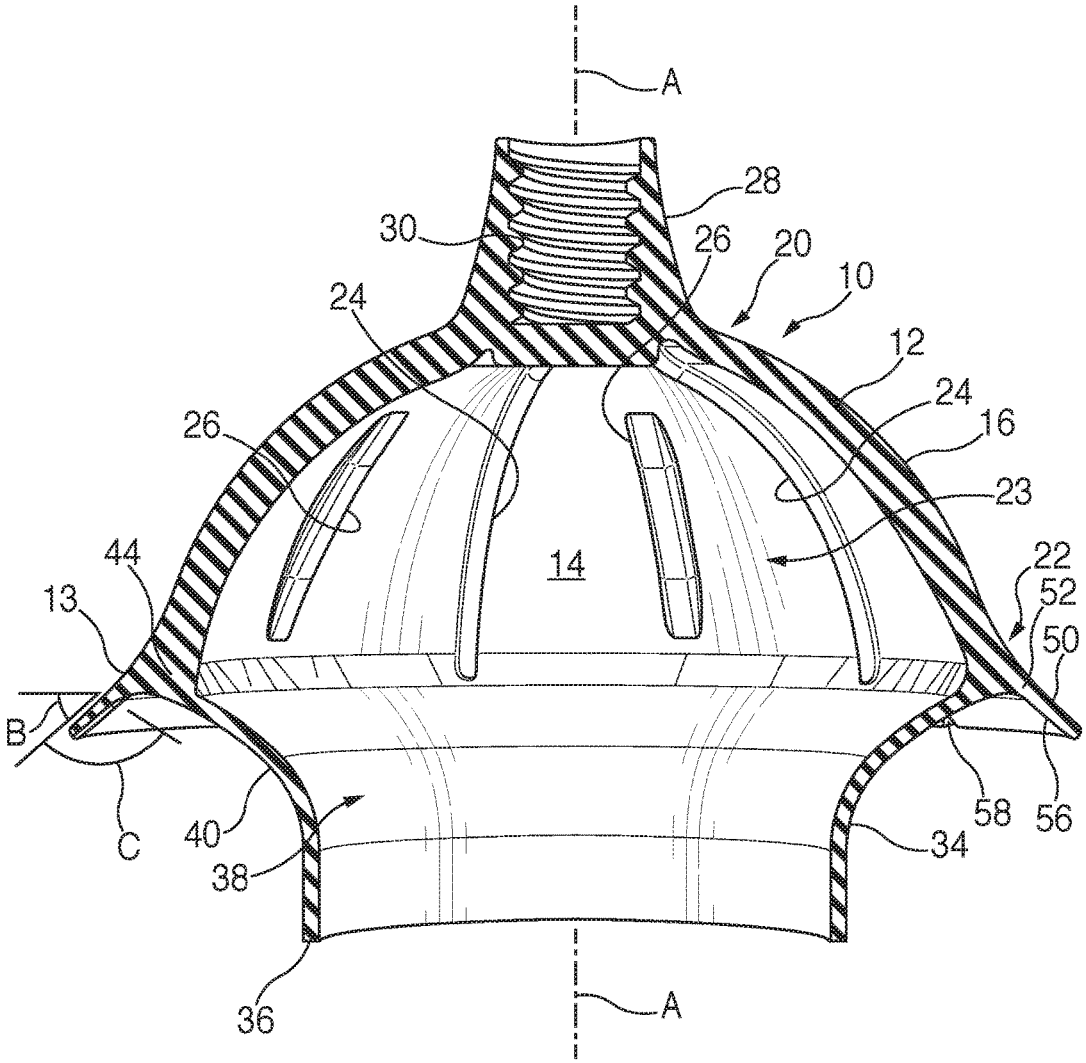
FIG. 2 is a side cutaway sectional view of the toilet plunger of FIG. 1.

The present disclosure is directed to a toilet plunger. Referring to FIGS. 1 and 2, a toilet plunger 10 is formed as a unitary body (one-piece construction) that is molded or formed from a resilient, deformable material. The material of the plunger 10 may be an elastomeric material, such as an elastomer or combination of elastomers, a natural or synthetic rubber or rubberized material, or any suitable material. In one embodiment, the material forming the plunger 10 has a Shore A durometer hardness of from about 65 to about 80, and in another embodiment, a Shore A durometer hardness of about 70.

The plunger 10 includes a generally cup-shaped bell portion 12 having an interior space 14. The bell portion 12 extends around and comprises about the upper half (according to the orientation in FIG. 2) of the plunger 10.

The bell portion 12 includes a sidewall 16 that defines the interior space 14. The sidewall 16, in one embodiment, has a generally constant thickness. The sidewall 16 may include one or more internal ribs 18. The one or more internal ribs 18 may extend from an upper end 20 of the bell portion 12 to a lower end 22 of the bell portion on an interior 23 of the sidewall 16. The one or more internal ribs 18 may extend the entire distance between the upper and lower ends 20, 22 or may extend only partially between the upper and lower ends. Thus, the one or more internal ribs 18 may include one or both of full ribs 24 that extend the entire distance between the upper and lower ends 20, 22, and partial ribs 26 that stop short of extending the entire distance between the upper and lower ends 20, 22. The internal ribs 18 may be generally rectangular reinforcements aligned with the axial direction A. In one embodiment, full ribs 24 are arranged alternatingly about the circumference of the bell portion 12 with partial ribs 26.

In the upper end 20, the bell portion 12 includes a receptacle in the form of a conventional handle socket 28. The socket 28 may include threaded walls 30 to threadably receive a handle 32 as is well known. The socket 26 is aligned with and may share the longitudinal axis A of the plunger 10.

The plunger 10 includes a flange portion 34 extending from the bell portion 12 opposite the socket 28. The point at which the flange portion 34 meets the bell portion 12 defines a junction 44 or a junction plane that is normal to the axis A and an approximate midpoint of the plunger 10.

The flange portion 34 includes an open end 36. The open end 36 is circular. The flange portion 34 includes an arcuate tapering tubular passage 38 such that the interior space communicates 14 with the open end 36. The flange portion 34 includes a funnel portion 40 adjacent and extending from the junction 44 and a cylindrical portion 42 adjacent and extending from the funnel portion 40 and extending to the open end 36. The funnel portion 40 may angle inwardly from the junction 44 towards the axis A at an angle of about 45°.

The flange portion 34 contacts and forms a primary seal to a toilet (not shown) as with similar designs and functions to direct pressurized fluid (gas and/or liquid) from the interior space 14 into plumbing passages of the toilet as the plunger 10 is pressed against the toilet and the interior space 14 collapses to compress air present therein. As can be appreciated, the quality and tightness of the seal formed around the open end 36 and the toilet, which closes off the internal volume of the interior space 14, will also determine the pressure buildup that the plunger uses to apply to the clog. To improve the seal of the interior space 14, the plunger 10, according to the disclosure, has an additional structure in the form of an annular skirt 50 that functions as a secondary seal with the toilet.

The annular skirt 50 is formed at the junction 44 of the bell portion 12 and the flange portion 34. The skirt 50 includes a base portion 52 that is attached to an outside wall 13 of the bell portion 12 and extends to a free, terminal end 54 that is opposite the base portion 52. The skirt 50 extends outwardly from the junction 44 and at an angle B such that the terminal end 54 is below the plane defined by the junction. The angle B, in one embodiment, may be from about 20° to about 70°. In another embodiment, the angle B may be from about 30° to about 60°. In yet another embodiment, the angle B may be about 45°. The skirt 50 may taper from the base portion 52 to the terminal end 54 or it may have a constant width. The skirt 50 may be about one centimeter in length to about one inch in length.

The skirt 50 includes a bottom surface 56 that includes one or more optional vents 58. The vents 58 may be grooved in the bottom surface 56 that run from the base portion 52 to the terminal end portion 54 or some of the distance therebetween in a generally radial direction away from the longitudinal axis A of the plunger 10. The vents 58 function to prevent the plunger 10 from being stuck in position to the toilet after compression and while a vacuum or a lower than atmospheric pressure is present within the interior space 14 while the plunger 10 is in a compressed mode. The vents 58 present a controlled leak path for air back into the internal space 14 by permitting a small amount of leakage between the plunger and the toilet bowl surface. The small amount of engineered leakage gradually fills the internal space 14 as the user retracts the plunger and thus prevents or reduces the occurrence of a sudden release of the seal between the plunger 10 and a toilet and reduces the changes of splashing or other undesired issues. The vents 58 may be arranged at 90° intervals about the skirt 50.

The bottom surface 56 of the skirt 50 may form an obtuse angle C with the funnel portion 40 of the flange portion 34 and helps form a secondary seal between the plunger 10 and the toilet. A primary seal is also formed in the area around the flange portion 34 such that two seals are formed to help build pressure of air present within the interior space 14 while a user is pushing the plunger against an opening in a plumbing fixture such as a toilet. In one embodiment, the obtuse angle C is from about 110° to about 130°. In another embodiment, the obtuse angle C is about 110°. In any case, the skirt 50 presents a larger diameter around the open end 36 along which the plunger 10 may contact the surrounding structures of the plumbing fixture. As contact occurs between the skirt 50 and the plumbing fixture, the reducing cross section of the skirt deforms to conform to the shape of the surrounding structure while also increasing the surface contact between the bottom surface 56 and the plumbing fixture, which surface contact ultimately provides the desired seal. For this reason, the vents 58 extend along an entire width in a radial direction relative to the longitudinal axis A, such that the secondary seal provided by contact between the bottom surface 56 and the plumbing fixture can be released in a gradual fashion as described above.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A resiliently deformable toilet plunger, comprising:

a generally cup-shaped bell portion having an interior space;

a socket formed on the bell portion;

a flange portion extending from the bell portion opposite the socket and including an open end, the flange portion defining an arcuate tapering tubular passage wherein the interior space communicates with the open end; and an annular skirt formed at a junction disposed between the bell portion and the flange portion, the skirt comprising a base portion attached to the bell portion and a terminal end opposite the base portion, the skirt extending outwardly from the junction and at an angle such that the terminal end is below a plane defined by the junction, wherein the angle is from about 20° to about 70°, wherein the skirt includes a vent formed on an undersurface of the skirt, the vent extending radially from the terminal end inwardly towards the junction.

2. The toilet plunger of claim 1, including a plurality of vents.

3. The toilet plunger of claim 2, including four vents.

4. The toilet plunger of claim 3, wherein the four vents are spaced apart about 90° circumferentially from adjacent ones of the four vents.

5. The toilet plunger of claim 1, wherein the skirt tapers from the base portion to the terminal end.

6. The toilet plunger of claim 1, wherein the angle is from about 30° to about 60°.

7. The toilet plunger of claim 1, wherein the angle is about 45°.

8. The toilet plunger of claim 1, wherein the bell portion includes a generally constant thickness wall.

9. The toilet plunger of claim 1, wherein the flange includes a funnel portion adjacent the junction and a cylindrical portion adjacent the open end.

10. The toilet plunger of claim 1, wherein the skirt includes an undersurface and wherein an angle between the undersurface and an outside of the funnel portion is obtuse.

11. The toilet plunder of claim 10, wherein the angle between the undersurface and the outside of the funnel portion is about 100-130°.

12. The toilet plunger of claim 1, wherein the socket is shaped and sized to receive a handle.

13. The toilet plunger of claim 1, wherein the bell portion includes an inside surface, the inside surface including a plurality of spaced reinforcing ribs.

14. The toilet plunger of claim 13, wherein the bell portion includes an upper end and a lower end, wherein the plurality of ribs extend between the upper end and the lower end.

15. The toilet plunger of claim 14, wherein at least one of the plurality of ribs extends the full distance between the upper end and the lower end.

16. The toilet plunger of claim 15, wherein one half of the plurality of ribs extends the full distance between the upper end and the lower end and the other half of the plurality of ribs extends less than the full distance between the upper end and the lower end.

17. The toilet plunger of claim 16, wherein the one half of the plurality of ribs that extend the full distance between the upper end and the lower end alternate circumferentially with the other half of the plurality of ribs.

* * * * *